US010350623B2

(12) United States Patent
Fleisch

(10) Patent No.: US 10,350,623 B2
(45) Date of Patent: Jul. 16, 2019

(54) CHANGING DEVICE FOR COATING MEDIA AND COATING SYSTEM FOR COATING OBJECTS

(71) Applicant: EISENMANN SE, Böblingen (DE)

(72) Inventor: Jürgen Fleisch, Lauffen am Neckar (DE)

(73) Assignee: EISENMANN SE, Böblingen (DE)

( * ) Notice: Subject to any disclaimer, the term of this patent is extended or adjusted under 35 U.S.C. 154(b) by 308 days.

(21) Appl. No.: 14/912,232

(22) PCT Filed: Aug. 5, 2014

(86) PCT No.: PCT/EP2014/002142

§ 371 (c)(1),
(2) Date: Feb. 16, 2016

(87) PCT Pub. No.: WO2015/022061

PCT Pub. Date: Feb. 19, 2015

(65) Prior Publication Data

US 2016/0199867 A1 Jul. 14, 2016

(30) Foreign Application Priority Data

Aug. 13, 2013 (DE) ..... 10 2013 013 549

(51) Int. Cl.
*B05B 12/00* (2018.01)
*B05B 12/14* (2006.01)

(52) U.S. Cl.
CPC ..... *B05B 12/149* (2013.01)

(58) Field of Classification Search
CPC ..... B05B 12/149
(Continued)

(56) References Cited

U.S. PATENT DOCUMENTS 5,078,302 A * 1/1992 Hellenberg ..... B01F 13/1058 141/104
5,950,874 A * 9/1999 Sindoni ..... B01F 13/1058 141/104

(Continued)

FOREIGN PATENT DOCUMENTS

CH 531900 A 12/1972
DE 1992220 A1 7/2001

(Continued)

*Primary Examiner* — Viet Le
(74) *Attorney, Agent, or Firm* — Lucas & Mercanti, LLP; Klaus P. Stoffel

(57) ABSTRACT

A changing device for coating media, including supply units that each have at least one inlet connection connectable to a reservoir, and an outlet connection, between which a flow channel extends. A coupling unit has an input connection and an output connection, connectable to an application device, between which input connection and output connection a through-channel extends. The coupling unit is movable in a positioning movement direction relative to the supply units by a positioning device. The input connection of the coupling unit is complementary to the outlet connections of the supply units so that the input connection of the coupling unit is movable in a coupling movement direction relative to one of the supply units and can be coupled to or disconnected from the outlet of the supply unit. The positioning device only moves the coupling unit in a plane in which the coupling movement direction also lies.

9 Claims, 11 Drawing Sheets

(58) Field of Classification Search
USPC ..... 239/112, 305, 397, 302, 303, 304; 222/14, 16, 144, 144.5, 129, 135, 517, 222/554
See application file for complete search history.

(56) References Cited

U.S. PATENT DOCUMENTS 8,176,950 B2 * 5/2012 Luchinger ..... G01F 11/00 141/104
8,567,341 B1 * 10/2013 Thies ..... B05B 7/1404 118/310

FOREIGN PATENT DOCUMENTS

| | | | |
|---|---|---|---|
| DE | 10115471 | A1 | 10/2002 |
| EP | 1245295 | B1 | 5/2004 |
| EP | 2554275 | A1 | 2/2013 |
| WO | 2004050259 | A1 | 6/2004 |
| WO | 2014177261 | A1 | 11/2014 |

* cited by examiner

CHANGING DEVICE FOR COATING MEDIA AND COATING SYSTEM FOR COATING OBJECTS

The present application is a 371 of International application PCT/EP2014/002142, filed Aug. 5, 2014, which claims priority of DE 10 2013 013 549.4, filed Aug. 13, 2013, the priority of these applications is hereby claimed and these applications are incorporated herein by reference.

BACKGROUND OF THE INVENTION

The invention relates to a changing device for coating-media, in particular for lacquers, with a) several supply units, each of which exhibits at least one inlet port, which can be connected to a reservoir, and one outlet port, between which a flow channel extends;

b) at least one coupling unit which exhibits an input port and an output port, which can be connected to an application device, between which a through-channel extends;

c) a positioning device, by means of which the coupling unit can be moved relative to the supply units in at least one positioning-motion direction;

wherein d) the input port of the coupling unit is complementary to the outlet ports of the supply units in such a manner that the input port of the coupling unit can be moved relative to one of the supply units in a coupling-motion direction and can be coupled with the outlet of this supply unit and separated again from the latter.

In addition, the invention relates to a coating system for coating objects, with:

a) an application device;

b) several reservoirs for a respective coating-medium;

c) at least one changing device with several inlet ports, each of which has been connected to its own reservoir for coating-medium, and with at least one output port which has been connected to the application device and through which a coating-medium can optionally be conducted out of a reservoir to the application device.

A changing device of such a type and a coating system of such a type are known from EP 1 245 295 B1, for example.

For example, in the case of a lacquering shop a changing device for coating-media, i.e. a colour-changing device, is employed when in normal operation it happens relatively frequently that for the coating of an object a lacquer is to be used that is different from the lacquer with which a previous object was lacquered.

In the case of the changing device according to EP 1 245 295 B1, the coupling unit is moved in two directions in a plane that is perpendicular to the coupling-motion direction. In this case, the supply units have been arranged in a matrix in front of the coupling unit. With respect to the coupling-motion direction, this changing device requires space for the supply units and for the coupling unit.

SUMMARY OF THE INVENTION

It is an object of the present invention to create a changing device and a coating system of the aforementioned type, with which the changing device can be constructed in more space-saving manner.

This object is achieved with a changing device of the aforementioned type, in that e) the positioning-motion device has been set up in such a way that the coupling unit can be moved only in a plane in which the coupling-motion direction also lies.

According to the invention, it was recognised that a changing device in which all the supply units and the coupling unit have been arranged in a common plane, and which complies with this alternative motion concept, can be operated in space-saving manner.

In this case it is favourable if the coupling unit can be moved in the positioning-motion direction on a linear path of motion.

Alternatively or additionally, however, it is also possible that the coupling unit can be moved in the positioning-motion direction on at least one portion of a circular path.

Preferentially, the positioning-motion direction has been set up in such a way that the positioning-motion direction is a first positioning-motion direction, and the coupling unit can, in addition, be moved by the positioning device in a second positioning-motion direction with a motion component that is perpendicular to the first positioning-motion direction, the two positioning-motion directions and of the coupling unit and the coupling-motion direction lying in the common plane. In this case, the coupling unit can be moved in the plane in two directions relative to the supply units. Details on this point will be elucidated further below.

The coupling unit may advantageously have been supported so as to be mobile in one or more guide rails and/or on a rotary element.

It is favourable if the supply units have been encompassed by a linear supply module in which the supply units have been arranged linearly and all the outlet ports point in the same direction.

The number of supply modules in the plane can be increased, by several linear supply modules having been arranged in a plane, the axes of the outlet ports of the supply units of all the supply modules lying in this plane.

Alternatively, the supply units may have been encompassed by a supply drum in which the supply units have been arranged in the form of a circle in a plane and all the outlet ports point in a radial direction with respect to the midpoint of the supply drum.

In this case, several supply drums with different diameters may advantageously also have been arranged coaxially with respect to one another and in a plane.

With regard to the coating system, the object specified above is achieved by virtue of the fact that d) the changing device is a changing device with some or all of the aforementioned features.

The advantages in this case correspond analogously to the advantages elucidated respectively in relation to the changing device.

BRIEF DESCRIPTION OF THE DRAWING

Embodiments of the invention will be elucidated in more detail below on the basis of the drawings. Shown in these drawings are.

DETAILED DESCRIPTION OF THE INVENTION

Figure 1:
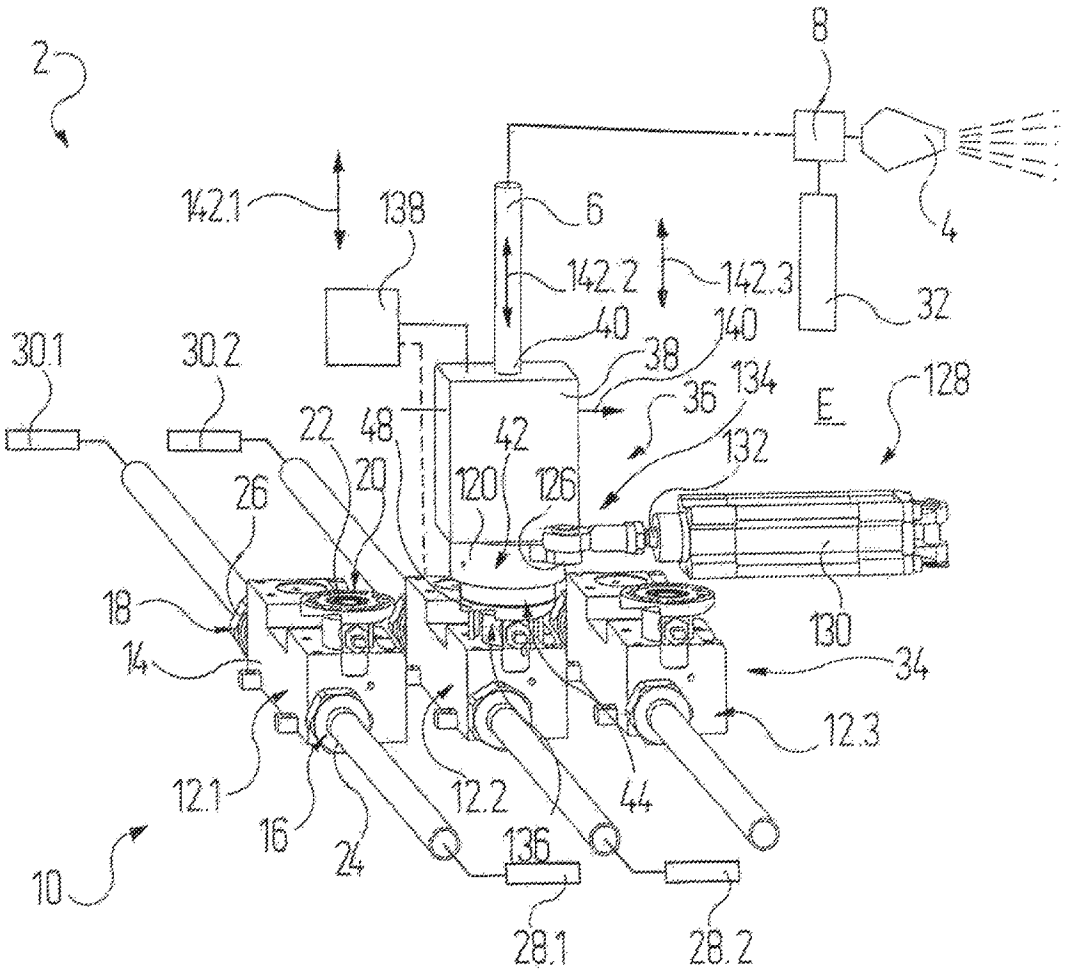
FIG. 1 a partial perspective view of a coating system with a linear changing device with several supply units and with a coupling unit, which can be locked to said supply units, with a multi-part locking head in a release configuration.
Figure 2:
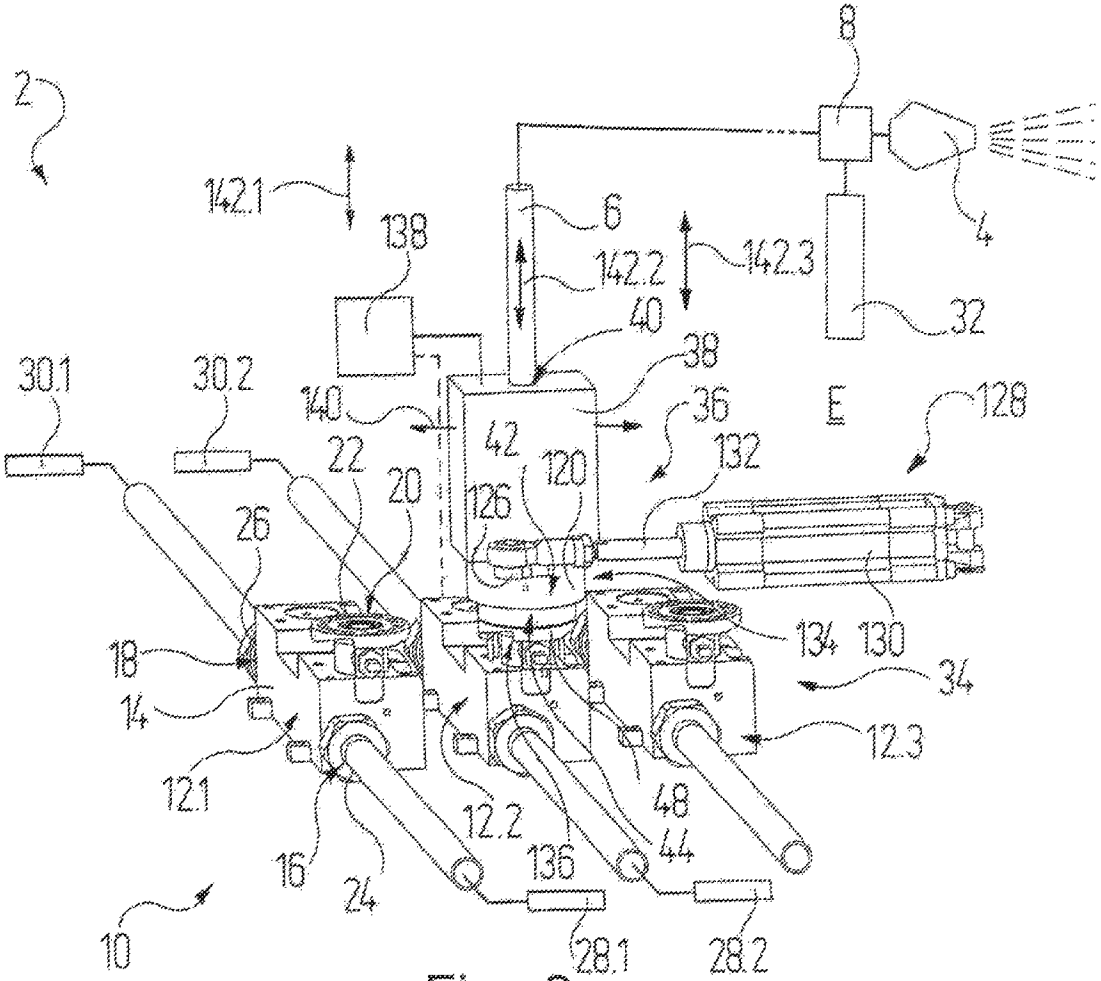
FIG. 2 a partial perspective view of the coating system corresponding to FIG. 1, wherein the locking head of the coupling unit is shown in a locking configuration.

Reference will firstly be made to FIGS. 1 and 2. Therein a coating system, which includes an application device 4, for applying coating-media is denoted overall by 2. In the present case a coating system 2 for lacquers will be described in exemplary manner. In this case, the application device may be, for example, a spray gun or a high-speed rotating atomizer, such as is known in itself.

Whenever a connection of ports, channels or lines is mentioned in the following, in each instance a fluidic connection of such components is primarily meant thereby, as a result of which corresponding flow paths are formed. Terms used in the following—such as inlet, outlet, input or output or corresponding ports—relate merely to a flow of medium in the direction of the application device. However, as will become clear further below, medium may also flow in the other direction and in this case may flow out through an inlet or input or may flow in through an outlet or output.

The application device 4 is fed via a line 6. The coating system 2 is operated, in a manner known as such, by using pig technology, for which reason a pig station 8 has been arranged in dose proximity to the application device 4 in the line 6. At the end remote from the application device 4, the line 6 has been connected to a changing device 10 for coating-media, which in the case of a coating with lacquer is consequently a colour-changing device.

The changing device 10 comprises several supply units 12, merely three supply units 12.1, 12.2 and 12.3 being shown in FIGS. 1 and 2. The changing device 10 comprises at least two, and may also comprise more than three, such supply units 12. Depending on the application, the changing device 10 may exhibit, for example, 20 or even 40 such supply units 12. The supply units 12 are of identical construction; in FIG. 1 only supply unit 12.1 has been provided with further reference symbols.

A supply unit 12 includes a housing 14 which, for example, may take the form of a housing block. The housing 14 has an inlet port 16 for coating-medium, a flushing-agent port 18 for flushing agent, and an outlet port 20. The inlet port 16 and the flushing-agent port 18 open into a flow channel 22 which leads to the outlet port 20 and of which only a short end portion can be discerned in FIGS. 1 to 5.

The inlet port 16 and the flushing-agent port 18 of a supply unit 12 can each be closed or opened separately by a corresponding colour valve 24 and flushing valve 26, respectively. For this purpose, needle valves known as such may, for example, have been provided, which respectively cooperate with corresponding valve seats of the inlet port 16 and of the flushing-agent port 18.

The inlet ports 16 of the individual supply units 12 have each been connected to their own colour reservoir 28, this being illustrated only in FIGS. 1 and 2, where merely two such colour reservoirs 28.1 and 28.2 are shown. In the respective colour reservoirs 28 assigned to a particular supply unit 12 differing lacquers—that is, generally differing coating-materials—are held.

The flushing-agent ports 18 of the individual supply units 12 have been respectively connected to a collecting tank 30. In this case, several supply units 12 may also have been connected to one and the same collecting tank 30. A flushing-agent reservoir 32 has been connected to the pig station 8 on the application device 4.

Understood by 'reservoir' in the present case will be any technical solution for providing or receiving differing media. Ring-line systems such as are known in themselves consequently also count as reservoirs, for example.

The individual supply units 12 have been combined in a linear arrangement and attached to one another to form a supply module 34 via which the application device 4 can be supplied with a corresponding number of different colours.

In order to conduct a colour from one of the supply units 12 to the application device 4, a coupling unit 36 has been linked to the end of the line 6 remote from the pig station 8, by means of which the supply units 12 can be coupled with the application device 4.

The coupling unit 36 includes a pig station 38 with an output port 40 which has been linked to the line 6. In addition, the coupling unit 36 includes a locking head 42 which carries an input port 44 which has been designed to be complementary to the outlet ports 20 of the supply units 12 and fluidically connected, via a channel 46 to be discerned in FIGS. 3 to 5, to the pig housing 38 and, in this way, to the line 6.

Figure 6:
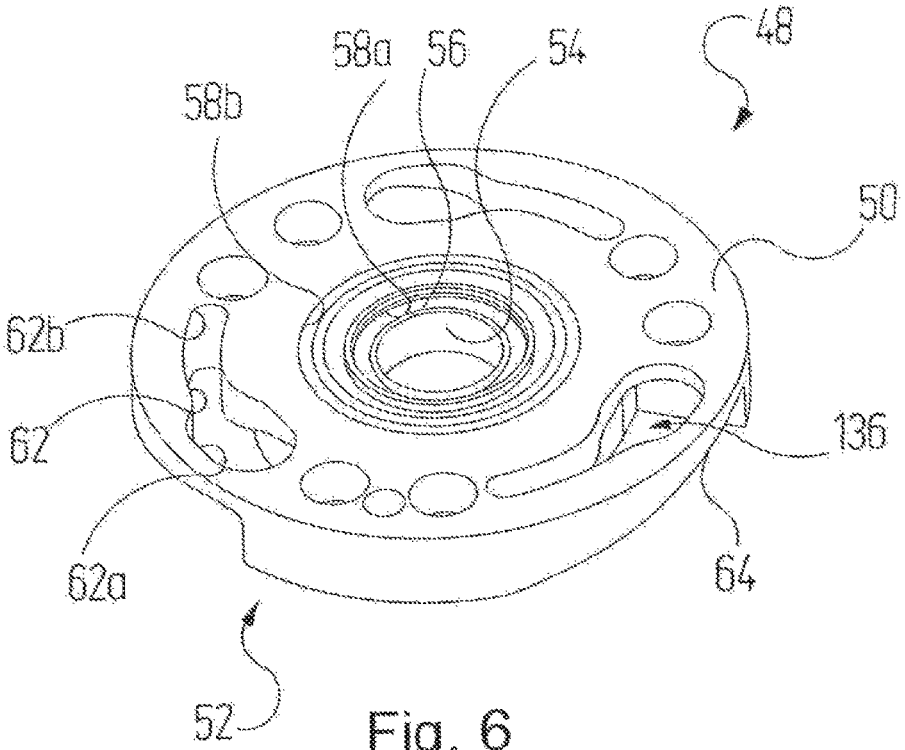
FIGS. 6 and 7 perspective views of a connecting plate of an outlet port of the supply units.
Figure 7:
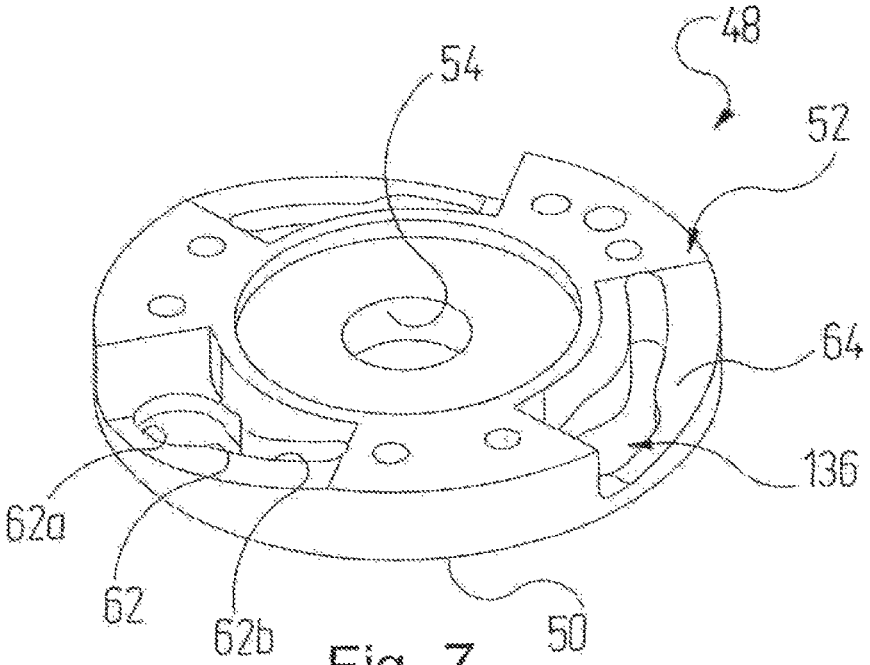

The outlet port 20 of the supply units 12 will firstly be described on the basis of FIGS. 6 and 7. Said outlet port comprises a connecting plate 48 with a free connecting surface 50 and with a locking side 52 which faces towards the housing 14. The connecting plate 48 includes a central through-channel 54 which forms an end portion of the flow channel 22, elucidated above, of the supply units and is radially surrounded by the connecting surface 50. On the side thereof the through-channel 54 exhibits a lowered step 56 with an annular groove 58*a* which is coaxial with the through-channel 54 and in which a sealing O-ring 60*a* is situated. Radially adjacent to the step 56 there extends in the connecting surface 50 a further annular groove 58*b* in which a further O-ring 60*b* is situated.

The connecting plate 48 exhibits three elongated, regularly arranged locking ducts 62 extending on an imaginary circle, which in the in top view of the connecting surface 50 have, in the clockwise direction, an insertion portion 62*a* and, compared thereto, a narrower locking portion 62*b*. On the locking side 52 the connecting plate 48 exhibits a locking ramp 64 along each locking duct 62. Said locking ramp has been formed by virtue of the fact that the thickness of the connecting plate 48 increases from the start of the insertion portion 62*a* up to the end of the locking portion 62*b* of the locking ducts 62.

Figure 8:
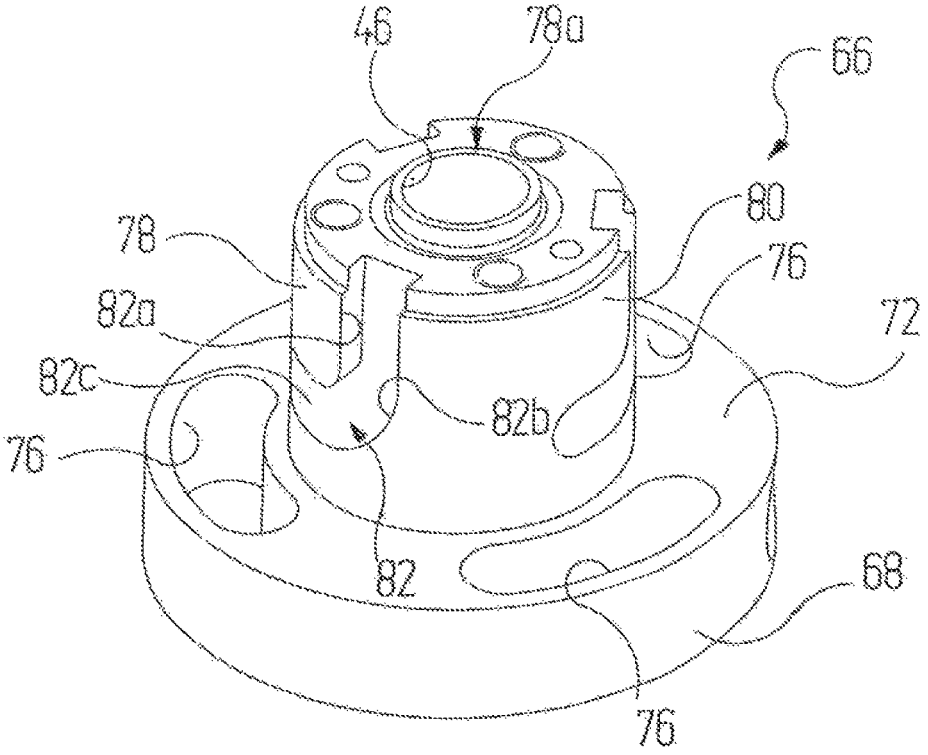
FIGS. 8 and 9 perspective views of a connecting plunger of the locking head.
Figure 9:
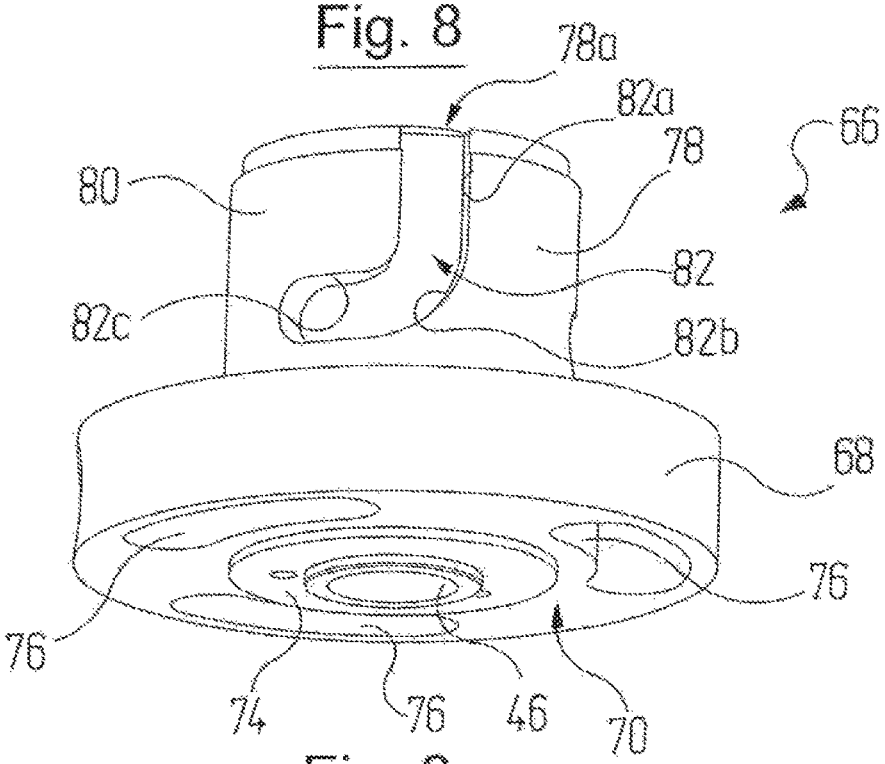

The input port 44 of the locking head 42 has been formed by a cylindrical connecting element in the form of a connecting plunger 66 which is shown in FIGS. 8 and 9 and through which the channel 46 extends coaxially. The connecting plunger 66 exhibits a connecting flange 68 with a free connecting side 70 and with an opposing flange surface 72. On the connecting side 70 the connecting plunger 66 exhibits an insertion ring 74 which is coaxial with the channel 46 and which has been designed to be complementary to the step 56 of the connecting plate 48 of a supply unit 12 and can be inserted in exactly fitting manner into the step 56 of the through-channel 46, so that the connecting side 70 of the connecting plunger 66 bears against the O-rings 60*a*, 60*b*. In this way, a fluid-tight connection between a supply unit 12 and the coupling unit 36 can be established.

Between the connecting side 70 and the flange surface 72 of the connecting flange 68 there extend three regularly distributed elongated holes 76, the contour and dimensions of which are complementary to the locking ducts 62 in the connecting plate 48 of the supply units 12. In particular, the elongated holes 76 are as wide as the insertion portions 62*a* of the locking ducts 62.

The connecting flange 68 is borne by a guide cylinder 78 which on its free end face 78*a* remote from the connecting flange 68 has been designed in such a way that the through-channel 46 can be fluidically linked to pig station 38. Situated opposite the free end face 78*a*, the guide cylinder 78 also defines the connecting side 70 of the connecting plunger 66.

Three guide grooves 80 which have been arranged at regular intervals from one another have been worked into the external circumferential surface 80 of the guide cylinder 78. Said guide grooves have a linear portion 82*a*, axially parallel to the guide cylinder 76 and emanating from the free end face 78*a* thereof, then follow, in an arcuate portion 82*b*, a 90° bend which finally merges with a locking portion 82*c* which extends perpendicularly in relation to the linear portion 82*a*. In top view of the free end face 78*a* of the guide cylinder 78, the arcuate portion 82*b* and the locking portion 82*c* follow the clockwise direction.

Figure 10:
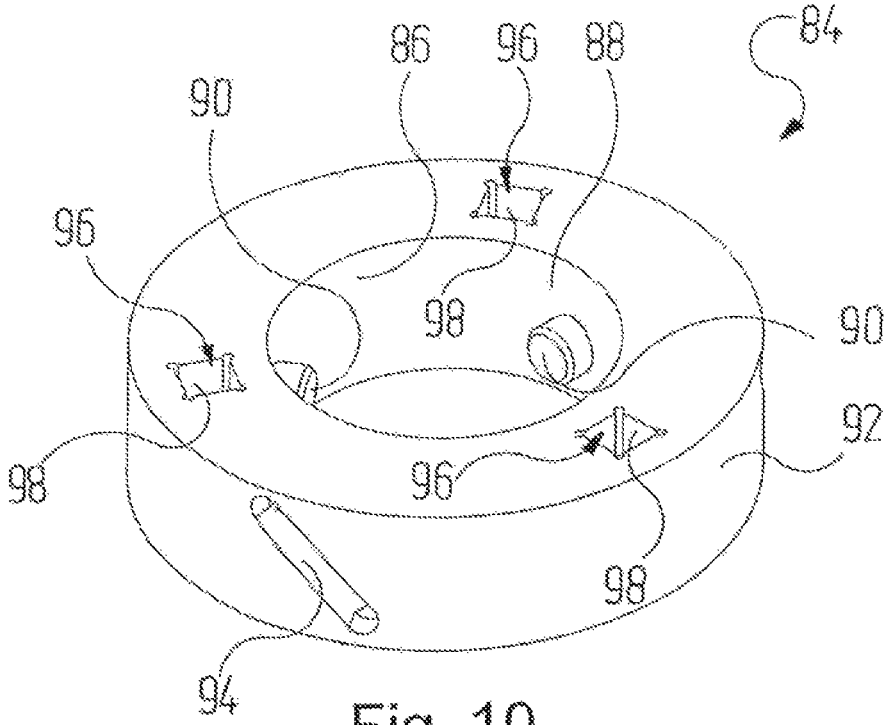
FIGS. 10 and 11 perspective views of a locking ring of the locking head.
Figure 11:
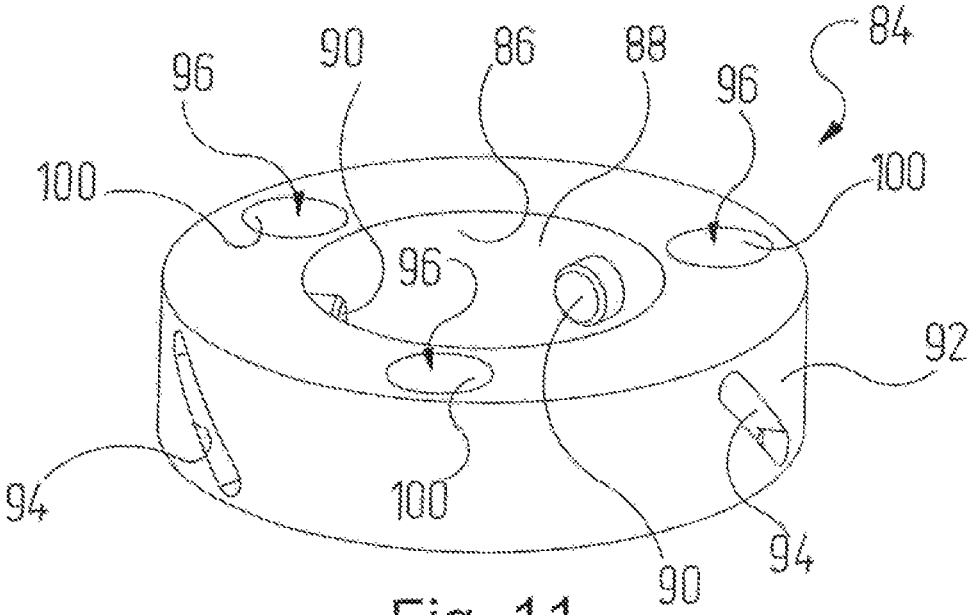

The locking head 42 includes, in addition, a locking ring 84 shown in FIGS. 10 and 11, which has a coaxial duct 86 with an inside diameter that is complementary to the outside diameter of the guide cylinder 78 of the connecting plunger 66. The internal circumferential surface 88 of the locking ring 84 bears three guide lugs 90 projecting radially therefrom and arranged regularly in the peripheral direction, which in their positions and dimensions are complementary to the guide grooves 80 of the connecting plunger 66. In this way, the locking ring 84 can be pushed coaxially onto the guide cylinder 78 of the connecting plunger 66, whereby the guide lugs 90 are inserted into the guide grooves 80 thereof.

Three diagonal grooves 94, again arranged at regular intervals, have been recessed into the external circumferential surface 92 of the locking ring 84, said diagonal grooves extending from top left to bottom right when the locking ring 84 has been oriented horizontally.

The locking ring 84 has, in addition, three axially parallel ducts 96 with two portions that have differing cross section, namely a plug-in portion 98 with square cross section and a countersunk portion 100 with round cross section which, in addition, has a larger diameter than the plug-in portion, so that an abutment step 102 has been formed at the transition of portions 98, 100.

Figure 3:
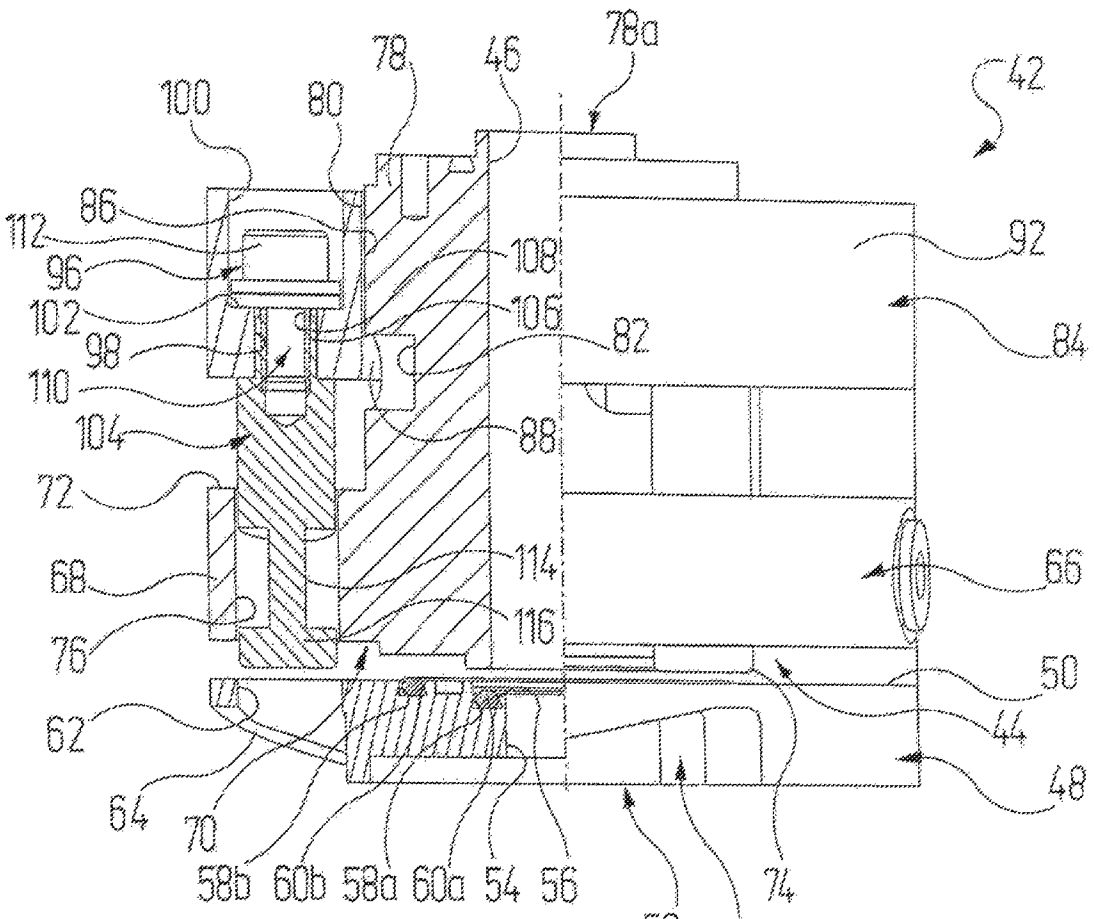
FIG. 3 a partial section of the locking head of the coupling unit in its release configuration upstream of an outlet port of a supply unit.
Figure 4:
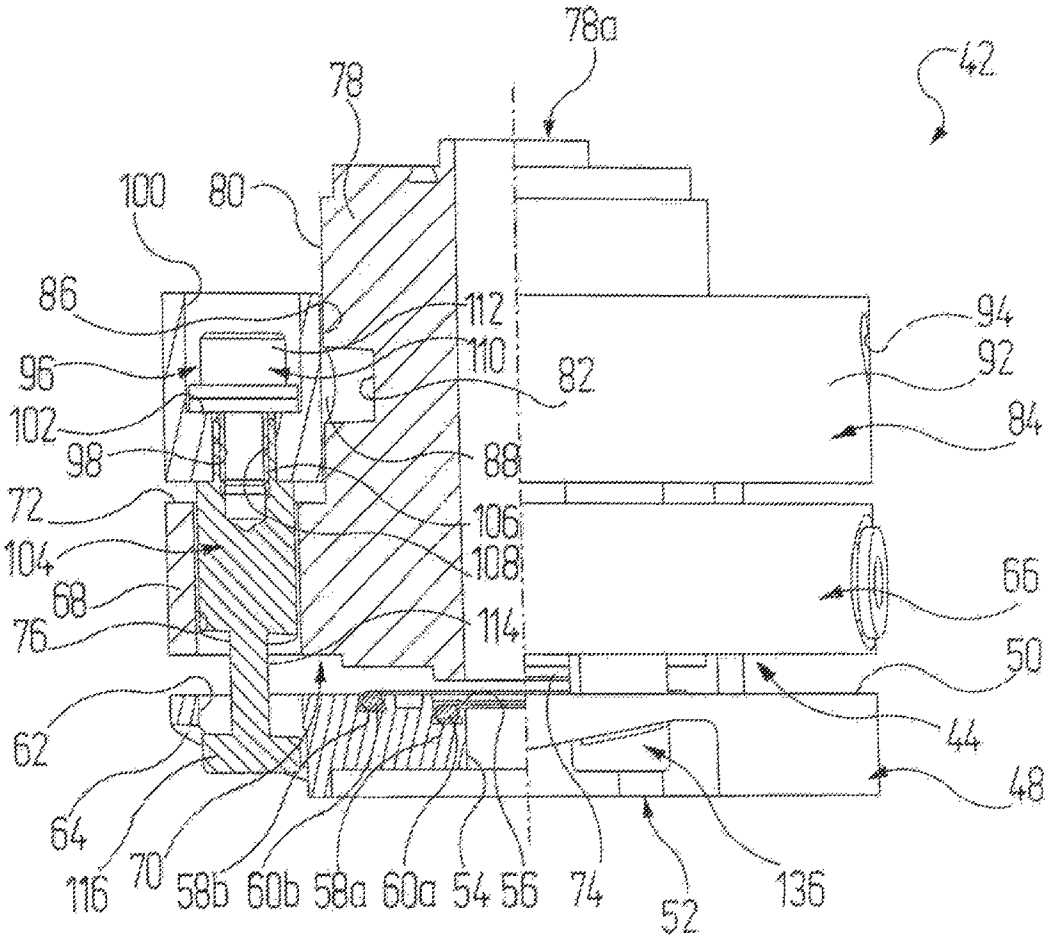
FIG. 4 a partial section corresponding to FIG. 3 with the locking head of the coupling unit in an intermediate configuration.
Figure 5:
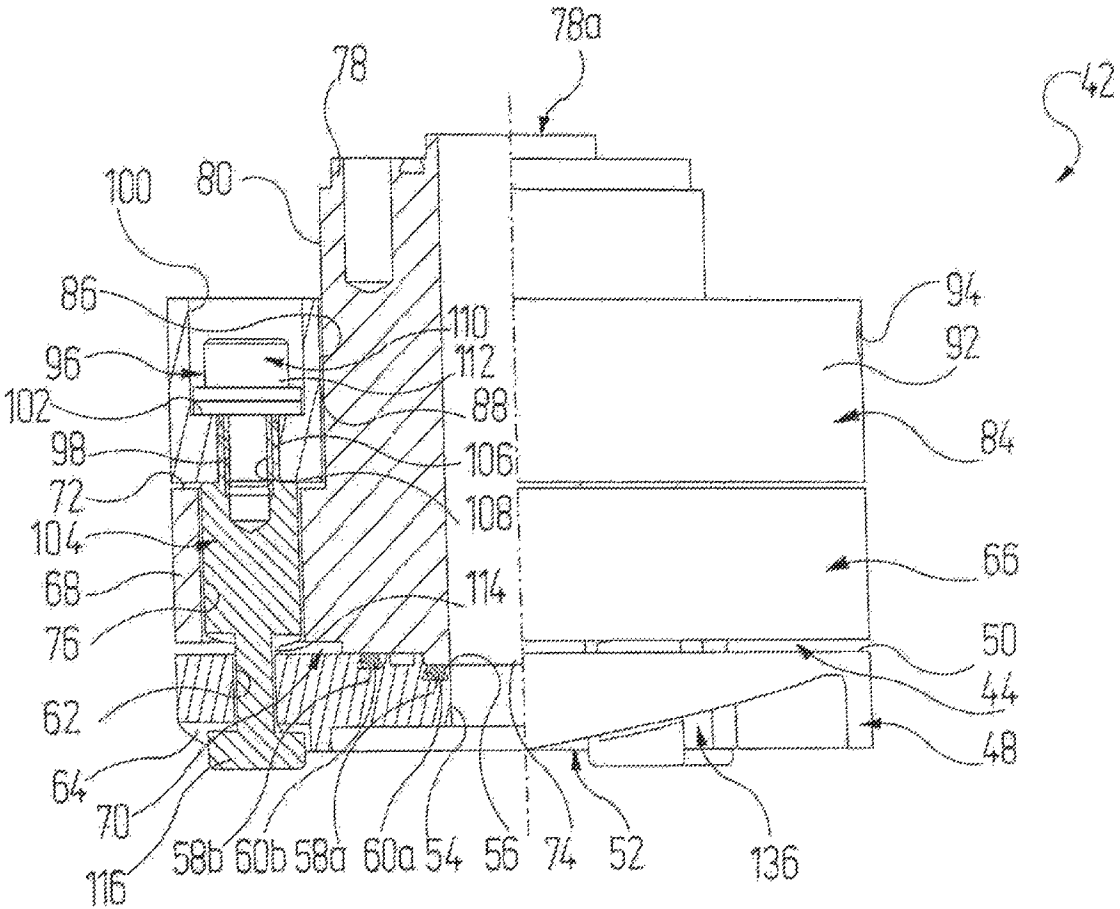
FIG. 5 a partial section corresponding to FIGS. 3 and 4 with the locking head in a locking configuration.
Figure 13:
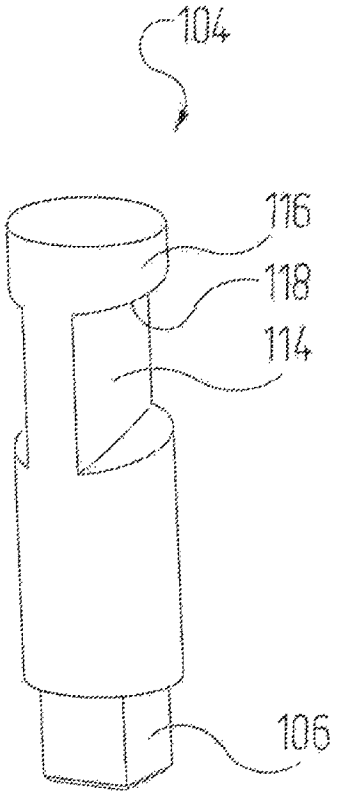
FIG. 13 a perspective view of a locking bolt of the locking head.
Figure 12:
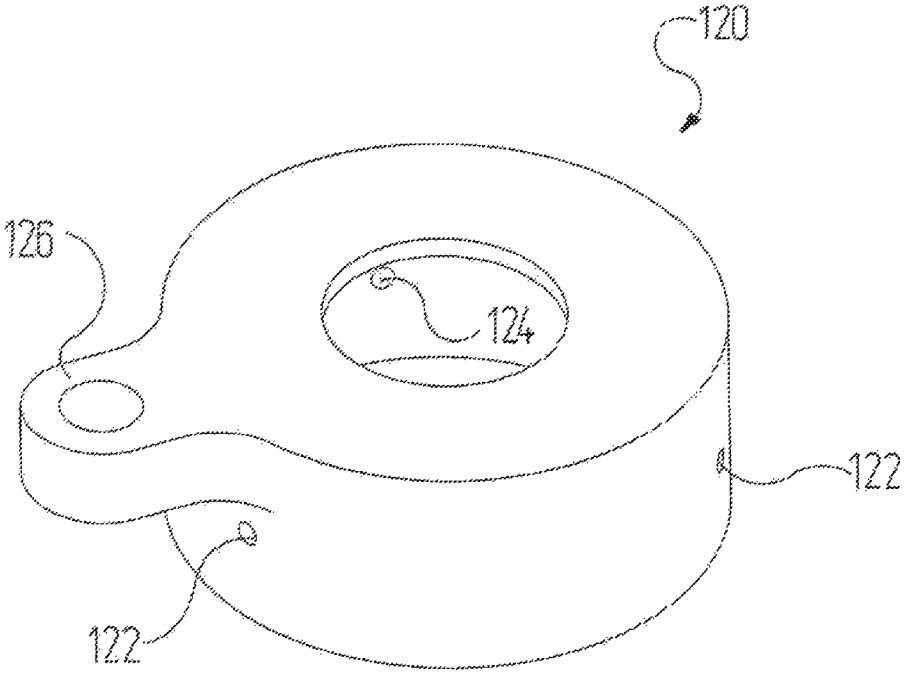
FIG. 12 a perspective view of an actuator sleeve of the locking head.

In the plug-in portions 98 there is, in each instance, a locking element, shown in FIG. 13, in the form of a locking bolt 104 with a plug-in head 106 that in cross section and length is complementary to the plug-in portions 98 which otherwise project in axially parallel manner from the locking ring 84; the latter is apparent on the basis of FIGS. 3 to 5. The plug-in head 106 of the locking bolt 104 has a coaxial threaded bore 108 in which a counter-screw 110 (see FIGS. 3 to 5) coming from the countersunk portion 100 of the duct 96 can engage, the screw head 112 of which can then abut the abutment step 102. In this way, the locking bolts 104 have been attached to the locking ring 84.

At its end region remote from the plug-in head 106 the locking bolt 104 exhibits an obliquely formed waist 114, so that it terminates in a mushroom-shaped locking end 116 with inclined conducting surfaces 118 which flank the waist 114. The inclination of the conducting surfaces 118 is complementary to the inclination of the locking ramps 64 of the connecting plates 48 of the supply units 12. The locking end 116 will be designated in the following as the mushroom head 116.

Finally, the locking head 42 also includes an actuator sleeve 120 which can be pushed onto the locking ring 84. The wall of the actuator sleeve 120 exhibits three through-tapped bores 122 into which guide pins 124 projecting radially inwards can be screwed. In the operating condition, these guide pins 124 engage in a respective one of the diagonal grooves 94 of the locking ring 84, so that the latter can be moved relative to the actuator sleeve 120 with a superposition of a rotary motion and an axial motion.

On its external circumferential surface the actuator sleeve 120 bears an attachment eye 126 on which an actuator device 128 can be applied. As shown in FIGS. 1 and 2, the actuator device 128 may be, for example, an actuator cylinder 130 with a cylinder rod 132, the free end of which has been articulated on the attachment eye 126 of the actuator sleeve 120. The actuator cylinder 130 can be operated hydraulically or pneumatically.

Expressed generally, the actuator device 128 together with the locking ring 84, the locking bolts 104 and the actuator sleeve 120 forms a locking device 134. With this locking device 134 the input port 44, i.e. in the present embodiment the connecting plunger 66, of the coupling unit 36 can be locked to one of the outlet ports 20 of the supply units 12. For this purpose, the locking device 134 cooperates with respective locking means 136 of one of the supply units 12, i.e. in the present embodiment with the connecting plate 48 of a supply unit 12 and with the locking ducts 62 thereof and with the respectively associated locking ramp 64.

For a change of colour, the supply units 12 and the coupling unit 36 can be moved relative to one another. For this purpose, the changing device 10 includes a positioning device 138 shown schematically in FIGS. 1 and 2, with the aid of which, in the present embodiment, the coupling unit 36 can be moved along the supply module 34 and positioned with respect to a predetermined supply unit 12.

The coupling unit 36 may, for example, have been displaceably supported in a guide rail which extends parallel to the supply module 34, and may be traversed therein with the aid of drive means known as such.

The mode of operation of the coating system 2 with the changing device 10 will now be elucidated, in particular, on the basis of FIGS. 1 to 5. In FIGS. 3 to 5 a partial section of the locking head 42 of the coupling unit 36 is shown in each instance.

FIG. 3 shows, as an example, an initial situation in which the coupling unit 36 has been positioned in a release configuration with the aid of the positioning device 138 in such a way that the connecting plunger 66 of the locking head 42 has been oriented coaxially with respect to the connecting plate 48 of supply unit 12.2.

In the release configuration, the locking ring 84 of the locking head 42 together with the locking bolts 104 has been positioned on the guide cylinder 78 of the connecting plunger 66 in such a way that the locking bolts 104 project through the elongated holes 76 of the connecting plunger 66 in the connecting flange 68 thereof and have been arranged above the insertion portions 62*a* of the locking ducts 62. In this way, the locking ring 84 has been spaced so far from the connecting flange 68 of the connecting plunger 66 that the locking mushrooms 116 on the connecting side 70 of the connecting plunger 68 terminate flush with the insertion ring 74 of the connecting plunger 66. In this case, the guide lugs 90 of the locking ring 84 are located in the linear portions 82*a* of the guide grooves 80 of the connecting plunger 66.

Now in order to couple the locking head 42 with the connecting plate 48 of supply unit 12.2, the actuator cylinder 130 is activated in such a way that the cylinder rod 132 extends and in the process rotates the actuator sleeve 120 appropriately. The actuator sleeve 120 has been coupled via its guide pins 124 with the locking ring 84, so that the guide pins 124 exert a force on the corresponding side face of the diagonal grooves 94 of the locking ring 84 in the course of the rotary motion. Since a rotary motion of the locking ring 84 is prevented by the guide lugs 90 in the linear portion 82 of the guide grooves 82, this force brings about an axial motion of the locking ring 84 onto the connecting flange 68 of the connecting plunger 66. In this process, the locking ring 84 itself does not rotate.

During this axial motion, the locking mushrooms 116 of the locking bolts 104 pass through the insertion portion 62*a* of the locking ducts 62 in the connecting plate 48 of supply unit 12.2 until the locking mushrooms 116 have each been positioned below the respective locking ramp 64.

The guide lugs 90 of the locking ring 84 are located in the bottom portion 82*b* at the level of the locking portion 82*c* of the guide grooves 82 if the locking ring 84 has moved so far towards the connecting flange 68 of the connecting plunger 66 until the locking ring 84 abuts the flange surface 72 of the connecting flange 68 of the connecting plunger 66. In FIG. 4 an intermediate configuration is illustrated in which the locking ring 84 has not yet quite reached the connecting flange 68 of the connecting plunger 66.

In the described position, a rotation of the locking ring 84 is now no longer blocked by the guide grooves 82, so that the locking ring 84 now rotates together with the actuator sleeve 120 if the cylinder rod 132 of the actuator cylinder 130 extends further. In the process, the guide lugs 90 retract into the respective locking portion 82*c* of the guide grooves 82 of the connecting plunger 66, as a result of which an axial motion of the locking ring 84 relative to the connecting plunger 66 has been blocked.

In the process, the locking ring 84 also moves the locking bolts 104, the locking mushrooms 116 of which are now guided along the locking ramp 64; in the process, the waists 114 of the locking bolts 104 move into the locking portions 62*b* of the locking ducts 62 of the connecting plate 48. By reason of the locking ramps 64, the locking ring 84 is pulled together with the connecting plunger 66 in the direction of the connecting plate 48 of supply unit 12.2 in the course of locking, whereby the insertion ring 74 of the connecting plunger 66 is inserted into the step 56 of the connecting plates 48, and the impervious fluid connection between the flow channel 22 of supply unit 12.2 and the channel 46 of the locking head is formed. Expressed generally, the locking device 134 of the coupling unit 36 and the locking means 136 of the supply units 12 have been set up in such a manner that, in the course of locking, the input port 44 of the coupling unit 36 and the outlet port 20 of the supply unit 12 move relatively towards one another in guided manner.

In a locking configuration shown in FIG. 5, the connecting plunger 66 with its insertion ring 74 and with a surface region radially surrounding said insertion ring finally bears in sealing manner against the O-rings 60*a*, 60*b* in the connecting plate 48 of supply unit 12.2.

Lacquer can now be conveyed out of colour reservoir 28.2 to the application device 4 and hence can be applied onto an object. The operation of the coating system 2 in itself, i.e. the flushing processes in the case of a change of colour, the drive of the colour valves 24 and of the flushing valves 26 of the supply module 34 and also the use of pigs between the pig station 8 on the application device 4 and the pig station 38 of the coupling unit 36, correspond to the state of the art.

For the purpose of propelling media or the pig in the line system formed by the channels and lines that have been elucidated, use may be made of medium pressure of lacquer, flushing agent, air, $CO_2$, nitrogen and the like, which are provided in a manner known as such. Components required for this purpose—such as media sources, lines, valves and ports—have not been shown expressly in the Figures, for the sake of clarity.

After completion of the application with the lacquer from lacquer reservoir 28.2, optionally a change of colour may be effected to a second lacquer having a different colour, for example a lacquer from colour reservoir 28.1 of supply unit 12.1

Now if such a change of colour is to be carried out, firstly the first lacquer—which is located in the line 6, in the coupling unit 36 and in the flow channel 22 of supply unit 12.2—is pressed back into colour reservoir 28.2 of supply unit 12.2. For this purpose, the pig is pressed out of pig station 8 into the pig station 38 of the coupling unit 36 by flushing agent from the flushing-agent reservoir 32 on the application device 4 with the aid of a pressure medium such as compressed air, which acts on the flushing agent, via the line 6. The colour valve 24 of supply unit 12.2 is open in this case, as a result of which the lacquer is pressed back into colour reservoir 28.2. This is not shown in the Figures.

Optionally, flushing agent can be dispensed with. In this case, the pig will have compressed air applied to it directly and in this way will be guided through the line 6.

If the pig is located in pig station 38, the colour valve 24 of supply unit 12.2 is closed and the flushing valve 26 thereof is opened. The presence or absence of the pig in pig station 38 or in pig station 8 can be ascertained with the aid of established detection methods. Suitable for this purpose are, for example and in known manner, initiators, magnetic-vortex probes, light barriers and also light-conducting and ultrasonic techniques or even a determination of the pig positions by pressure measurements or quantity measurements with respect to the coating-medium conveyed.

If flushing agent now continues to be pressed out of the flushing-agent reservoir 32, the lacquer still present in supply unit 12.2 and in the coupling unit 36 is carried away through the flushing-agent port 18 into the collecting tank 30 until only flushing agent is located in the channels. Said flushing agent then continues to be expressed from the flushing-agent port 18 by air until only air is located in the lines and channels.

The flushing valve 26 is then dosed, and with the aid of the actuator cylinder 130 the coupling unit 36 is separated from supply unit 12.2, by the cylinder rod 132 of said actuator cylinder being retracted. In this case, the processes elucidated above take place in the reverse order until the coupling unit 36 has been detached from supply unit 12.2.

The coupling unit 36 is then moved by the positioning device 138 in a positioning-motion direction 140, illustrated by arrows, to supply unit 12.1 and is coupled with the latter. In the course of this, the processes described above in respect of supply unit 12.1 are carried out, via which lacquer from reservoir 28.1 can then be applied. In the present embodiment, the motion of the coupling unit 36 in the positioning-motion direction 140 occurs on a linear path of motion.

In the course of the coupling of the coupling unit 36 with one of the supply units 12, the coupling unit 36 is moved towards the supply unit in a coupling-motion direction 142.

In the present embodiment, this coupling motion 142 is linear, points towards one of the supply units 12 or away from the latter, and is illustrated in FIGS. 1 and 2 by arrows 142.1, 142.2 and 142.3, respectively, for each supply unit 12.1, 12.2, 12.3 shown. With respect to the direction of motion there is consequently no difference, irrespective of the supply unit 12 of the supply module 34 with which a coupling is to occur. At each supply unit 12 the coupling unit 36 is moved in the coupling direction 142 when the coupling process is carried out.

Both the positioning-motion direction 140 and the coupling-motion direction 142 lie in a common plane E which in FIGS. 1 and 2 corresponds to the plane of the drawing. The supply units 12 of the supply module 34 have also been arranged in this plane E.

The positioning-motion device 138 has been set up in such a way that the coupling unit 36 can be moved only in this plane E in which the coupling-motion direction 142 also lies. The coupling unit 36 cannot be moved in a direction that is perpendicular to this plane E.

In the present embodiment, the changing unit is a so-called linear colour-changer, in which the supply units 12 and the coupling units 36 can be moved relative to one another only in a common plane, which here again corresponds to the plane E. In this case, the relative positioning motion between the supply units 12 and the coupling unit 36 occurs in a linear motion in the single positioning-motion direction 140 there.

Figure 14:
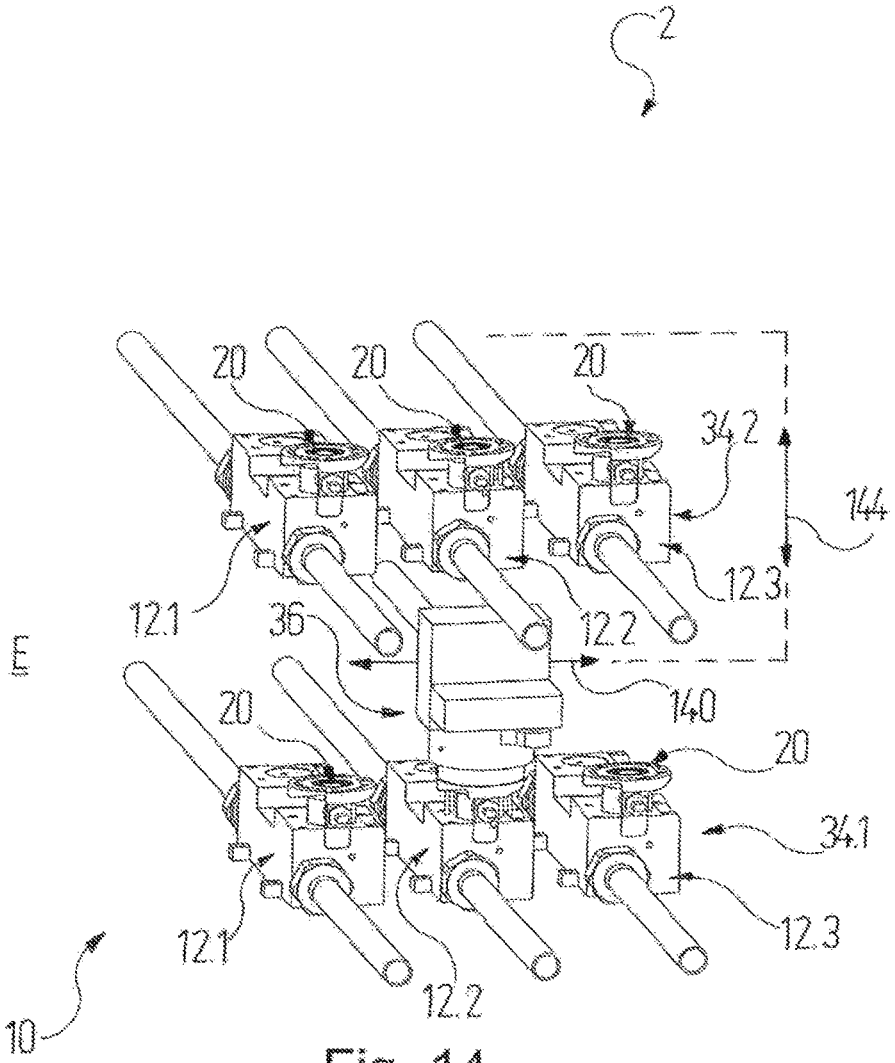
FIG. 14 a perspective view of a modified coating system with a multi-tier linear changing device.

FIG. 14 shows a coating system 2 with a modified changing device 10 which has been designed as a multi-tier linear changing device. The application device 4, pig station 8 and the flushing-agent reservoir 32 on pig station 8, the reservoirs 28 and 30 and the actuator device 128 and also the positioning device 138 have, for the sake of clarity, not been shown therein expressly, and only the essential components have been provided with a reference symbol.

In this embodiment, two or even more linear supply modules 34 with supply units 12 may be present, two supply modules 34.1 and 34.2 being shown in FIG. 14. These supply modules have been arranged adjacent to one another in such a way that the outlet ports 20 of the first supply module 34.1 point towards the supply units 12 of the adjacent supply module 34.2. If a third supply module 34.3 were present, the outlet ports 20 of this second supply module 34.2 would point towards the supply units 12 of the adjacent supply module 34.3. Expressed otherwise, the axes of the outlet ports 20 of the supply units 12 of all the supply modules 34 lie in the plane E.

Between two adjacent supply modules 34 a sufficient spacing remains in this case, so that the coupling unit 36 fits between two supply modules 34 and can be moved there in the positioning-motion direction 140, as illustrated in FIG. 14. The supply units 12 of all the available supply modules 34 have consequently been arranged in the plane E.

In practice, the individual supply modules 34 have been arranged above one another in the vertical direction, but a horizontal arrangement of the supply modules 34 alongside one another is also practicable, in which case the outlet ports 20 of the supply units 12 then point to the side.

The coupling unit 36 can, for example, be moved at one of the ends of the supply modules 34 in the plane E from one supply module 34 to the next. A part of the possible path of motion of the coupling unit 36 is indicated in FIG. 14 by a dashed line. Alternatively or additionally, one supply unit 12 in a supply module 34 may also be omitted, so that the coupling unit 36 can be moved through the passage obtained in this way.

For this purpose, the coupling unit 36 may, for example, have been displaceably supported in a rail system in which guide rails have been linked to one another, parallel to the supply module 34, by cross-rails, so that a transition between the guide rails is possible.

In this embodiment, the positioning-motion direction 140 is a first positioning-motion direction of the coupling unit 36 which, in addition, can be moved by the positioning device 138 in a second positioning-motion direction 144 with a motion component that is perpendicular to the first positioning-motion direction 140. As a rule, the first positioning-motion direction 140 and the second positioning-motion direction 144 are perpendicular to one another. The two positioning-motion directions 140, 144 of the coupling unit 36 then lie in the common plane E in which the coupling-motion direction 142 also lies. In both positioning-motion directions 140, 144 the motion of the coupling unit 36 occurs on a linear path of motion.

Figure 15:
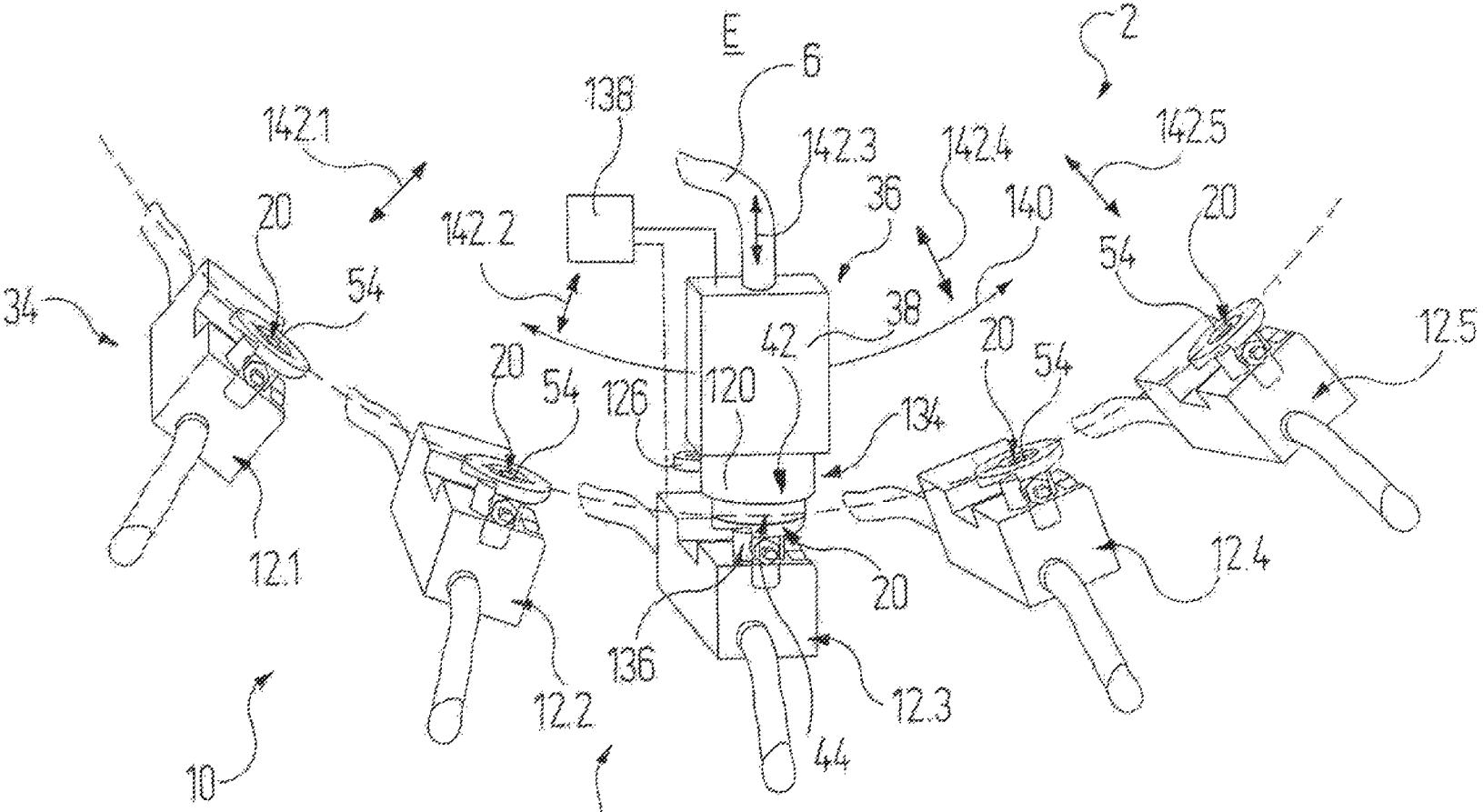
FIG. 15 a perspective view of a coating system with a circular changing device.

FIG. 15 shows a coating system 2 with a changing device 10 which has again been modified and which has been designed as a circular changing unit. The application device 4, pig station 8 and the flushing-agent reservoir 32 on pig station 8 and also the reservoirs 28 and 30 and the actuator device 128 have also not been shown expressly therein, for the sake of clarity.

In the case of the supply module 34 according to this embodiment, the supply units 12 have been arranged in the form of a circle in the plane E, so that a supply drum 146 has been formed. In this case, the outlet ports 20—i.e. in the present case, the connecting plates 48 of the individual supply units 12—have been directed radially inwards, the axis of the respective through-channels 54 of the connecting plates 48 intersecting the midpoint of the circle spanned by the supply units 12. In FIG. 15, five supply units 12.1, 12.2, 12.3, 12.4 and 12.5 are shown in exemplary manner.

The coupling unit 36 has been arranged offset radially inwards with respect to the supply units 12, its input port 44 pointing radially outwards. With the aid of the positioning device 138 the coupling unit 36 can be traversed in the positioning-motion direction 140 on a circular path, the midpoint of which is identical with the midpoint of the circle that is described by the supply units 12. In this embodiment, the actuator device 128 which is not shown in FIG. 15 can act on the actuator sleeve 120 of the locking head 42, for example from in front of or from behind the plane of the drawing.

The coupling unit 36 may, for example, have been arranged on a rotary element, such as a rotary table, which has been supported coaxially with and alongside the supply drum 146 and can be rotated with the aid of drive means known as such.

As an alternative to the arrangement shown, the supply units 12 can also be moved in relation to the coupling unit 36. In a further modification, which is not shown expressly, the coupling unit 36 may also have been arranged radially outside the supply drum 134, and its input port 44 may point radially inwards. In this case, the supply units 12 have been oriented in such a way that the outlet port 20 thereof point radially outwards.

In the course of coupling the coupling unit 36 with one of the supply units 12, the coupling unit 36 is again moved in a coupling-motion direction 142. Also in the present embodiment, this coupling motion is linear, points in the direction of one of the supply units 12, and is illustrated in FIG. 14 by an arrow 142.1, 142.2, 142.3, 142.4 and 142.5 for each supply unit 12.1, 12.2, 12.3, 12.4, 12.5 shown. Here, however, the coupling directions 142.1, 142.2, 142.3, 142.4 and 142.5 are different from one another and, depending on the supply unit 12 of the supply module 34 with which a coupling is to be effected, point in different radial directions.

But also in this embodiment both the positioning-motion direction 140 and the coupling-motion direction 142 lie in the common plane E which in FIG. 15 also corresponds to the plane of the drawing and in which the supply units 12 of the supply module 34 have been arranged. Also in this embodiment, the coupling unit 36 just cannot be moved in a direction that is perpendicular to this plane E.

In a modification which is not shown expressly, also two or more supply drums 146 with several supply units 12 and with equal diameters may have been arranged coaxially in succession. In this case, the positioning device 138 for the coupling unit 36 has been set up in such a way that the coupling unit 36 can also be traversed in directions axially parallel to the supply drums 146, so that it can be moved from one supply drum 146 to another and back again.

Corresponding to the changing device 10 according to FIG. 15, in a further modification, which is not shown, two or even more rings with supply units 12 having different diameters may have been arranged coaxially and in the common plane E. Accordingly, several annular supply drums 146 having different diameters are then present. In the case of the radially inner supply drum 146, at one or more places the spacing between two supply units 12 may have been chosen to be so large that the coupling unit 36 is guided through this passage to the radially outer ring and in this way can cooperate with the supply units 12 there.

For this purpose, the coupling unit 36, for example on the aforementioned rotary element, may additionally be traversable in a radially extending guide rail, so that the coupling unit 36 can be positioned both on the circular path and in the radial direction.

The positioning-motion direction 140 along the circular path is then again a first positioning-motion direction of the coupling unit 36 which, in addition, can be moved by the positioning device 138 in a second positioning-motion direction with a motion component that is perpendicular to the first positioning-motion direction 140. In the case of the circular path of the coupling unit 36, 'perpendicular' means that the second positioning-motion direction extends radially in relation to this circular path. As a rule, the first positioning-motion direction 140 and the second positioning-motion direction are perpendicular to one another. The two positioning-motion directions of the coupling unit 36—expressed generally, at least one positioning-motion direction—and the coupling-motion direction 142 of the coupling unit 36 then lie in the common plane E.

Common to all the embodiments of the changing unit 10 that have been elucidated is the concept that the coupling unit 36 can be moved only in a plane E in which the coupling-motion direction 142 also lies.

Two changing devices 10 described above can also be operated in parallel in a coating system 2. In comparison with a coating system 2 having only one changing device 10, a change of colour can then be effected more quickly. While lacquer from reservoir 28.2 is being applied, for example via a first changing device 10, a second changing device 10 and the line 6 thereof can already be flushed as far as pig station 8. After this flushing process, the next lacquer, for example from reservoir 28.1, can then already be submitted as far as pig station 8. In the event of a change of colour, the portion of the line 6 between pig station 8 and the application device 4 can be flushed with flushing agent from the flushing-agent reservoir 32 via pig station 8.

Such a parallel or alternating operation of two changing devices is known in itself and therefore does not need to be elucidated further.

The invention claimed is:

1. A changing device for coating-media, in particular for lacquers, comprising:

a) several supply units arranged in a common plane, each of the supply units having at least one inlet port and an outlet port, between which a flow channel extends;

b) at least one coupling unit having an input port and an output port, between which a through-channel extends;

c) a positioning-motion device arranged to move the coupling unit relative to the supply units in at least one positioning-motion direction on at least one portion of a circular path in the common plane; wherein d) the input port of the coupling unit is complementary to the outlet ports of the supply units so that the input port of the coupling unit is movable relative to one of the supply units in a coupling-motion direction along a radius of the circular path and is coupleable with the outlet of the supply unit and separable again from the outlet, wherein e) the positioning-motion device is arranged to only move in a plane in which the coupling-motion direction also lies.

2. The changing device according to claim 1, wherein the coupling unit is movable in the positioning-motion direction on a linear path of motion.

3. The changing device according to claim 1, wherein the positioning-motion direction is a first positioning-motion direction, and the coupling unit is additionally movable by the positioning-motion device in a second positioning-motion direction with a motion component that is perpendicular to the first positioning-motion direction.

4. The changing device according to claim 1, wherein the coupling unit is supported so as to be mobile in one or more guide rails and/or on a rotary element.

5. The changing device according to claim 1, wherein the supply units are encompassed by a supply module in which the supply units are arranged so that all the outlet ports point toward a center axis of the circular path.

6. The changing device according to claim 5, wherein several supply modules are arranged in a plane and axes of the outlet ports of the supply units of all the supply modules lying in the plane.

7. The changing device according to claim 1, wherein the supply units are encompassed by a supply drum in which the supply units are arranged in a circle in a plane, and all the outlet ports point in a radial direction with respect to a midpoint of the supply drum.

8. The changing device according to claim 7, wherein several supply drums with different diameters are arranged coaxially in relation to one another and in a plane.

9. A coating system for coating objects, with:

a) an application device;

b) several reservoirs for a respective coating-medium; and c) at least one changing device according to claim 1.

* * * * *